United States Patent [19]

Dreschel et al.

[11] Patent Number: 4,572,497

[45] Date of Patent: Feb. 25, 1986

[54] METHOD AND APPARATUS FOR COLLECTING FORM SHEETS IN A SET THEREOF

[75] Inventors: Jürgen Dreschel, Karben; Heinrich Möbs, Bad Nauheim; Peter Hög, Rockenberg, all of Fed. Rep. of Germany

[73] Assignee: Bell & Howell Company GmbH, Fed. Rep. of Germany

[21] Appl. No.: 684,403

[22] Filed: Dec. 20, 1984

[30] Foreign Application Priority Data

Sep. 12, 1984 [DE] Fed. Rep. of Germany ..... 3433497

[51] Int. Cl.[4] ..... B65H 39/02; B65H 3/08

[52] U.S. Cl. ..... 270/58; 271/112; 271/90; 271/195; 271/197; 198/369; 198/438; 198/803.5 J

[58] Field of Search ..... 270/21.1, 58; 271/5, 271/11-13, 90-99, 112, 184, 194-197; 198/366-367, 369, 380, 438, 689

[56] References Cited

U.S. PATENT DOCUMENTS

| | | | |
|---|---|---|---|
| 3,202,302 | 8/1965 | Insolo | 271/197 X |
| 3,345,166 | 11/1967 | Plumb | 27/195 X |
| 3,608,895 | 9/1971 | Kalven | 271/197 |
| 3,655,180 | 4/1972 | Holler | 270/58 |
| 3,733,068 | 5/1973 | Herring et al. | 271/112 X |
| 3,889,801 | 6/1975 | Boyer et al. | 271/197 X |
| 4,034,973 | 7/1977 | Hams | 270/58 X |
| 4,135,808 | 1/1979 | Morrison | 271/94 X |
| 4,181,298 | 1/1980 | Capdeboscq | 271/99 X |
| 4,273,319 | 6/1981 | Stocker | 270/58 |

FOREIGN PATENT DOCUMENTS

| | | | |
|---|---|---|---|
| 45436 | 2/1982 | European Pat. Off. | 271/90 |
| 1296093 | 5/1969 | Fed. Rep. of Germany | 198/369 |
| 2240761 | 3/1973 | Fed. Rep. of Germany | 271/98 |
| 48212 | 12/1982 | Fed. Rep. of Germany | 271/90 |
| 2054535 | 2/1981 | United Kingdom | 271/195 |

*Primary Examiner*—E. H. Eickholt

*Attorney, Agent, or Firm*—Griffin, Branigan, & Butler

[57] ABSTRACT

In an apparatus for collecting sheets in a set thereof, two juxtaposed receiving stations (16,17) receive incoming sheets. A transverse conveyor means (53) is utilized to transfer the contents of one receiving station to the other receiving station. The transverse conveyor means (53) has a conveyor belt (58) adapted to be revolved through a course of travel. The upper portion of the course of travel of the belt (58) lies substantially in the plane of a sheet-supporting surface (18). The conveyor belt (58) has perforations (52) provided therein. A source of vacuum communicates through a suction block (57) to the perforations (52). According to a disclosed method, a sheet is transversely transferred from one receiving station to the other when conveyor belt (58) is revolved and the perforations (52) in the conveyor belt (58) communicate with the source of vacuum.

20 Claims, 9 Drawing Figures

METHOD AND APPARATUS FOR COLLECTING FORM SHEETS IN A SET THEREOF

BACKGROUND OF THE INVENTION

1. Field of the Invention

This invention relates to methods and apparatus for handling sheets or documents, and particularly to methods and apparatus for assembling or collecting form sheets in a set thereof.

2. Prior Art and Other Considerations

In certain types of sheet or document handling equipment form sheets are prepared on a web in a format of rows and columns before the sheets enter two juxtaposed receiving stations of collecting or assembling apparatus. As used herein, the term "form sheet(s)" includes any paper sheets which are adapted to be assembled or collected in a set thereof and which differ in any feature which can be detected by sensing or scanning. The columns of incoming sheets, which may be separated into parallel strips prior to entrance into the receiving stations, extend on the web substantially parallel to the longitudinal direction of incoming travel. Rows on the web comprise sheets prepared substantially side-by-side with respect to a direction transverse to the direction of incoming travel.

In the prior art it has been known to use juxtaposed receiving stations to receive juxtaposed incoming form sheets, to use transverse conveyance means disposed in one of the receiving stations, and to transfer the contents of one receiving station to the other receiving station. The transfer occurs in a direction which is transverse to the direction of incoming travel of the form sheets to the apparatus.

Such apparatus is known from U.S. Pat. No. 4,273,319, and forms a constituent part of an automatic serial mailing system wherein a sheet web (provided with marks) is cut by a cutter into individual form sheets; wherein the form sheets are then fed on parallel paths and then folded (if desired); and, wherein the form sheets are subsequently assembled in sets in accordance with previously detected marks on the sheet web. For this purpose, the transverse conveyor must be operated to transfer a form sheet from one sheet-feeding path to the other sheet-feeding path if, e.g., the sheet web has been marked by a computer output printer (having one or two printing units) in such a manner that the sheet form areas which belong to a set of sheet forms and are provided with the same code marks are disposed in sequence on the sheet web in a zigzag arrangement.

In the known apparatus, the receiving station provided with the transverse conveyance means contains a continuously revolving, endless belt conveyor having an upper course which lies in the plane of a sheet-supporting surface of the receiving station and occupies a substantial portion of that supporting surface. When a sheet, which may have been folded, if desired, has been delivered from one of the substantially parallel sheet-feeding paths to the receiving station provided with the transverse conveyor, that sheet is not immediately transferred in the transverse direction by the revolving belt conveyor to the other receiving station. An immediate transfer does not occur because the movement of the sheet is obstructed by retractable stops which protrude upwardly in the region between the receiving stations and which initially block the path of the sheet to be conveyed in the transverse direction. Only when control signals (generated by a controller in response to the code marks detected on the scanned sheet web) cause the stops to be retracted and cause sets of drop rollers to descend (so as to urge the form sheet which is to be transferred against the continuously revolving belt conveyor) will that form sheet be transferred toward the other receiving station in the transverse direction. That other receiving station is disposed on a slightly lower level so that it can be used to stack sets of form sheets up to a predetermined height, whereafter the entire set of form sheets is delivered by the last-mentioned receiving station to e.g., an enveloping line comprising a revolving enveloping chain.

In the known apparatus the sheet web comprising juxtaposed printed or written form sheet areas is longitudinally cut to separate adjacent form sheets. The separated form sheets must then be moved sufficiently apart to provide between the juxtaposed form sheets, which are fed on the sheet-feeding paths, a space which permits (1) the form sheets to be moved at least past stop means in the receiving station provided with the transverse conveyor, and which also permits (2) the form sheets to be placed without obstruction into the receiving stations which are spaced a predetermined distance apart. When the form sheets have been separated in the longitudinal direction, they must be moved laterally apart along a substantial length of the substantially parallel sheet-feeding paths because the sheet web and the individual form sheets exhibit a delicate response to a sudden change in the direction of travel on a short length of the feeding path. The fact that the form sheets (which have been separated in the longitudinal direction) must be laterally moved apart along a substantial length of the parallel sheet-feeding paths increases the space requirement of the entire system and reduces the handling rate.

Further difficulties sometimes occur in the known apparatus when paper has piled up in the receiving station provided with the transverse conveyor. In such instances access from above the receiving station must be permitted so that the cause of trouble can be eliminated. In the known apparatus, the pressure-applying means and the sets of rollers which cooperate with the continuously revolving belt conveyor involve a complicated structure which precludes easy access. Moreover, the bottom of the receiving station of the known apparatus is not easily accessible because the pressure-applying devices and sets of rollers, as well as U-shaped holding-down and guiding members, cannot be easily lifted.

In view of the foregoing, it is an object of the present invention to provide sheet collecting method and apparatus which increases the operating speed and efficiency of an automatic serial mail handling system in conjunction with which the sheet collecting apparatus operates.

An advantage of the present invention is the provision of compact sheet collecting apparatus which requires little space.

A further advantage of the present invention is the provision of sheet collecting apparatus which is easily accessible for repair and troubleshooting purposes.

SUMMARY

A sheet collecting apparatus has transverse conveyance means comprising a belt conveyor which is provided with perforations and adapted to be revolved by drive means. The belt conveyor has an upper course of travel which lies substantially in the plane of a sheet-supporting surface of an associated receiving station and which travels over a suction block. The suction block is adapted to be connected to a vacuum source to effect a temporary conveyance of a sheet from one receiving station to another.

Because the transverse conveyor is adapted to effect a temporary conveyance in a manner which will be described in detail hereinafter, it is not necessary to provide retractable stops which block the travel of the sheet in the transverse direction upon entry into the receiving stations. In prior art apparatus such stops required a certain minimum spacing between the receiving stations and a transverse spacing of the juxtaposed form sheets being fed. In the apparatus proposed here the two receiving stations for receiving form sheets (separated by a longitudinal cut in the sheet web and by transverse cuts throughout the width of the sheet web) can be juxtaposed substantially without a lateral spacing. A cutter may be used first to make the cuts which extend throughout the width of the sheet web. The length sections of the sheet web may then be folded and, immediately before they enter the receiving stations, may be divided into folded form sheets by a longitudinal cut.

The transverse conveyor having the design stated here permits reliable handling of folded form sheets during the transfer thereof from one receiving station to the other and during the stacking of the form sheets in a set thereof.

In one embodiment the belt conveyor may be intermittently revolved whenever a form sheet belonging to a set is to be transversely transferred to the other receiving station. In this intermittently revolving embodiment the vacuum may be continuously applied to the suction block.

In a preferred embodiment the belt conveyor revolves continuously. In this embodiment the sheet-supporting surface of the receiving station provided with the transverse conveyor is formed with sheet-retaining vacuum openings. Application of the vacuum to the suction block of the belt conveyor and a disconnection of the vacuum from the sheet-retaining vacuum openings occurs whenever a form sheet belonging to a set is to be transversely transferred to the other receiving station.

The retaining vacuum openings are preferably aligned with the belt conveyor and disposed behind the belt conveyor opposite to its direction of transfer. The belt conveyor is desirably disposed in one receiving station in that part of its sheet-supporting surface which is adjacent to the other receiving station and near the entrance for the form sheets. In the apparatus described herein the belt conveyor occupies only a relatively small part of the sheet-supporting surface of the receiving station, e.g., a part on the order of one-tenth of the sheet-supporting surface. This will ensure a careful handling of the form sheets even when the belt conveyor revolves continuously.

The receiving station provided with the transverse conveyor (i.e. a first receiving station) has in some embodiments a sheet-supporting surface on a higher level than the sheet-supporting surface of the troughlike other receiving station (i.e. second receiving station). The second receiving station is used to collect the sets of form sheets. In this respect, alternate form sheets are delivered to the second troughlike sheet-feeding station both in the direction in which the sheets are fed on the parallel sheet-feeding paths and from the first receiving station in a direction which is at a right angle to the parallel incoming sheet-feeding paths.

If this feeding of the sheets to the sheet-collecting receiving station in alternating directions is to be avoided, for instance because a stacking of folded form sheets would involve a risk of additional form sheets being caught by the stack of form sheets, a modified embodiment may be adopted in which a trough-like receiving station for collecting the sets of form sheets is diagonally disposed relative to that receiving station which contains the transverse conveyor. In this modified embodiment the troughlike receiving station may succeed an additional receiving station which is disposed beside the receiving station containing the transverse conveyor.

In known sheet collecting apparatus the form sheets are mechanically held down in the receiving stations by U-shaped members disposed between pressure-applying means and stop means provided in the receiving stations. On the other hand, the apparatus of the kind disclosed herein advantageously comprises pneumatic pressure-applying means comprising at least one air least two such air blast tubes are preferably provided and extend over both receiving stations in a direction which is parallel to the direction of travel of the transverse conveyor. In combination with the vacuum-actuated transverse conveyor the pneumatic means for holding down the form sheets permit a substantial increase of the operating rate in conjunction with an appreciable simplification of the structure.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
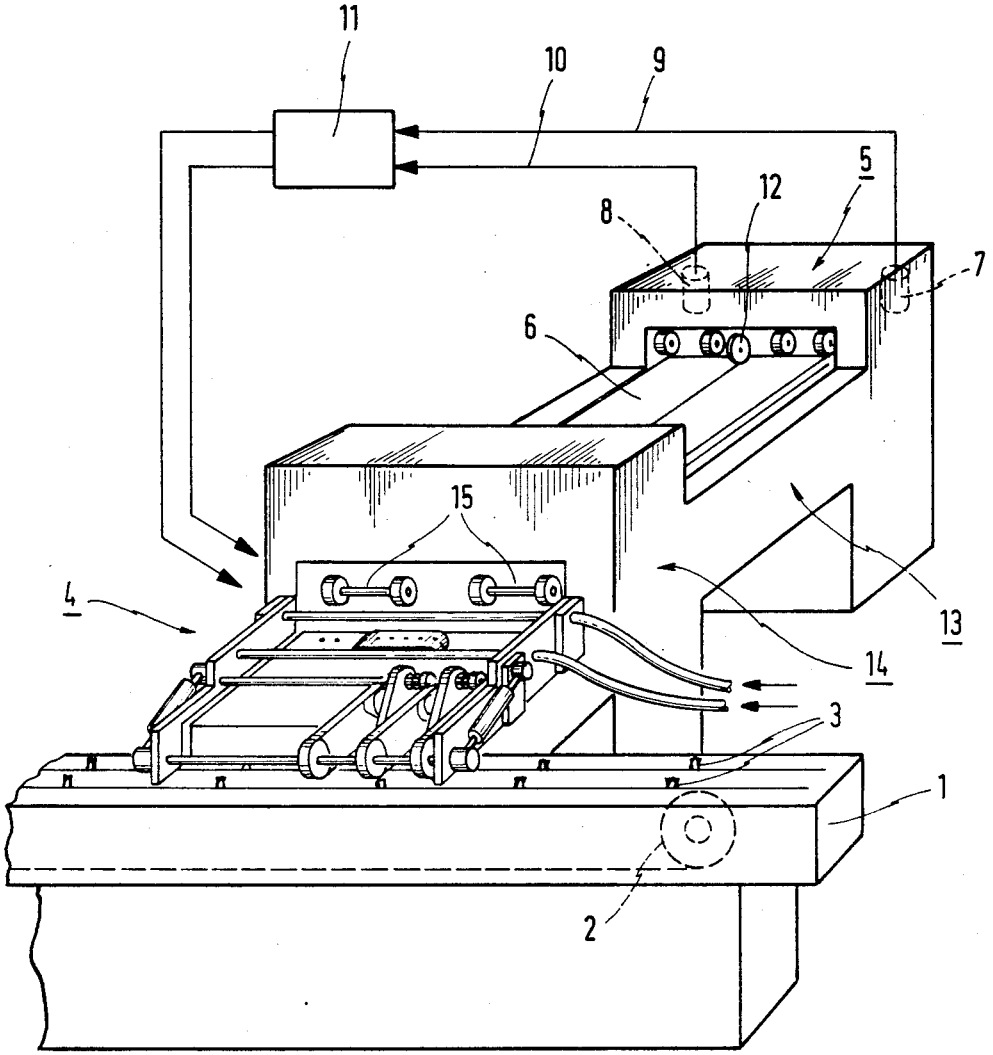
FIG. 1 is a diagrammatic perspective view showing apparatus for assembling sheets of forms in sets thereof as a constituent part of an automatic serial mailing system.

FIG. 1 shows part of an automatic serial mailing system including an enveloping line 1 comprising a diagrammatically indicated, revolving enveloping chain 2, which carries gripping fingers 3 moving along the enveloping line 1. Sets of stacked form sheets are adapted to be placed between adjacent gripping fingers 3 and to be delivered to an enveloping station (not illustrated), which is downstream along the enveloping line 1. The form sheets are assembled in sets in collector apparatus 4. Collector apparatus 4 comprises a constituent part of a plurality of handling and processing stations which are arranged in a row that extends transversely to the enveloping line 1.

An entrance station 5 receives a sheet web 6, which has a width of two form sheets. The sheet web 6 is folded in a zigzag shape and is a printout of a printer of an electronic computer and is trimmed by two laterally disposed, rotating cutter blades. The sheet web 6 comprises sheet form areas which are arranged in rows and columns and which bear inscriptions and code marks. Two code readers 7 and 8 are provided in the entrance station and respectively associated with the right-hand and left-hand columns of sheet form areas included in the sheet web. The code readers 7 and 8 are adapted to read the associated code marks and to deliver signals via lines 9 and 10 to a discriminating and control station 11, which in response to the signals indicates which of the form sheets derived from the scanned form sheet areas are to be assembled in a set.

For instance, the form sheets to be assembled in a given set may be constituted on the sheet web by a form sheet area on the right side, the juxtaposed form sheet area on the left side, and the next form sheet area behind the first-mentioned form sheet area. The signals delivered via the leads 9 and 10 will then cause the discriminating and control device 11 to control the apparatus 4 in such a manner that only the sheets constituted by said form sheet areas will be assembled in a stack and the sheets belonging to the next set thereof will be assembled in another stack.

In the entrance station 5 the sheet web may be divided by a guillotine cutter into a plurality of sheet web sections corresponding to the form sheet areas. Further, the sheet web may be cut in the longitudinal direction of the sheet web by a rotating blade 12. Thereafter, the several form sheets are conveyed on two substantially parallel sheet-feeding paths through a transfer station 13 wherein each sheet is retained and guided along one edge. The form sheets then reach a folding station 14 whereat each form sheet is folded transversely to its direction of travel on the sheet-feeding path. The form sheets are subsequently fed to the apparatus 4 for assembling or collecting the sets of form sheets. Feeding to the collector apparatus 4 is effected by means of the output roller assemblies 15 diagrammatically indicated in FIG. 1.

It is pointed out that the information read or detected by the code readers 7 and 8 is discriminated in the discriminating and control device 11. Device 11 generates a signal indicating that a given form sheet belongs to a specified set thereof. In response to the movement of that form sheet past detector elements provided along the sheet-feeding path in the transfer station 13 and in the folding station 14, the signal initially generated by device 11 is shifted, e.g., through a shift register, so that a control signal is delivered by the discriminating and control device 11 and is available in the apparatus 4 when the corresponding form sheet has arrived in the apparatus 4. In the illustrated embodiment the detector elements comprise photoelectric cells which are spaced apart along the sheet-feeding paths and which monitor the movement of the several form sheets.

Figure 2:
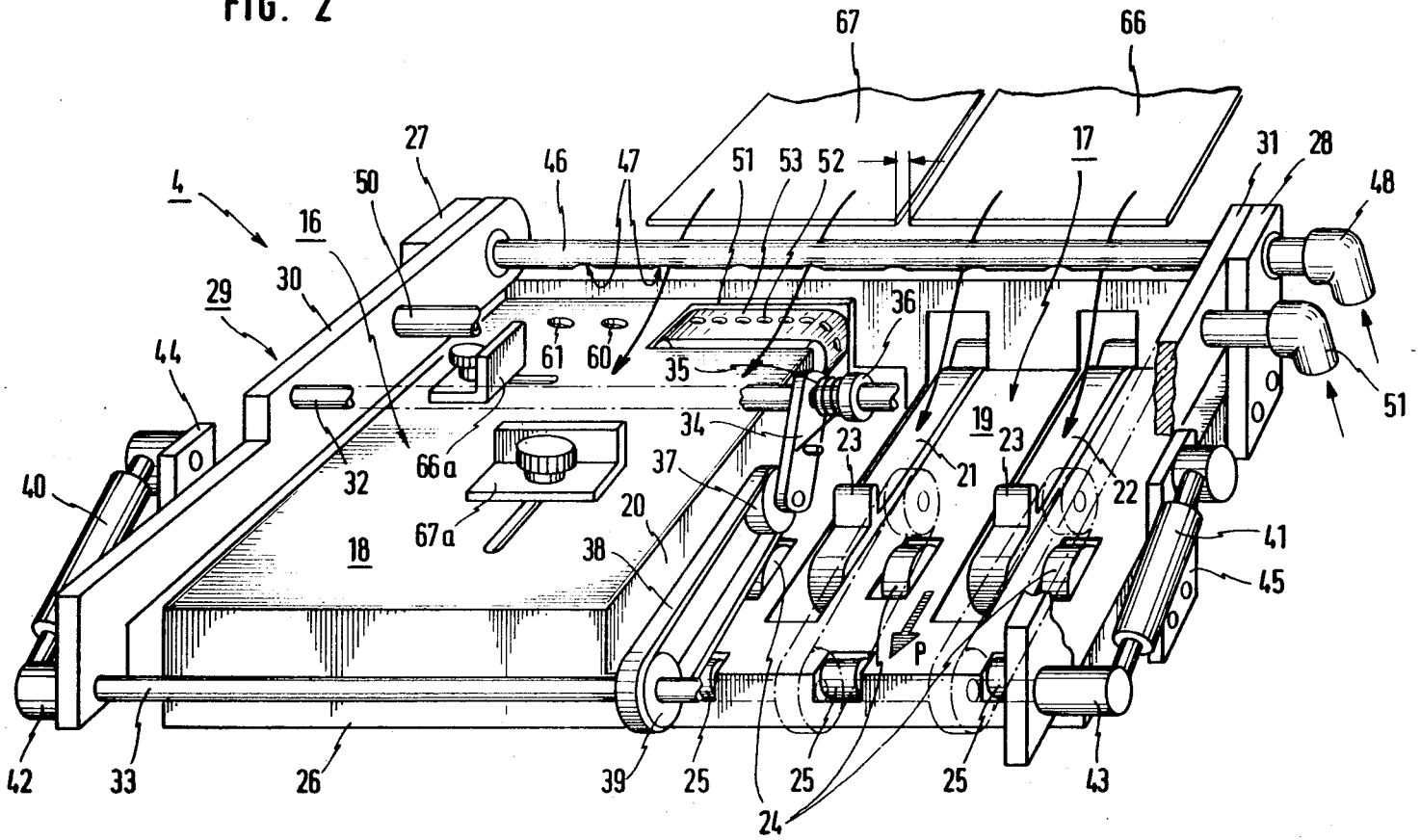
FIG. 2 is a perspective view showing the apparatus of FIG. 1 for assembling form sheets in sets thereof (with certain parts shown broken away for greater clarity)

The collecting apparatus 4 comprises two receiving stations 16 and 17 which are juxtaposed substantially without an intervening gap. In the embodiment of FIG. 2 a sheet-supporting surface 18 of the receiving station 16 is on a higher level than a sheet-supporting surface 19 of the receiving station 17. Accordingly, in the embodiment of FIG. 2 there is a step 20 from the sheet-supporting surface 18 down to the sheet-supporting surface 19.

The sheet-supporting surface 19 of the receiving station 17 is provided with longitudinally extending apertures in which the upper courses of respective cogged belts 21 and 22 extend. Belts 21 and 22 are provided in known manner with entraining and stop flights or lugs 23. Flights 23 protrude from the outside surface of the belt and may be integrally formed with the respective belt and spaced a predetermined distance apart along the belt. The cogged belts 21 and 22 extend over rollers which are rotatably mounted below the sheet-supporting surface 19. Those of said rollers which are nearest to the viewer in FIG. 2 are adapted to be coupled by solenoid clutches to drive means for predetermined intervals of time so that the cogged belts 21 and 22 are revolved clutches to drive means for predetermined intervals of time so that the cogged belts 21 and 22 are revolved simultaneously for the predetermined intervals of time. A stack of form sheets disposed between two pairs of entraining flights 23 is advanced in the direction of the arrow P by juxtaposed pairs of entraining flights 23 as belts 21 and 22 revolve.

The sheet-supporting surface 19 of the receiving station 17 is formed with additional apertures which are disposed beside the apertures containing the cogged belts 21 and 22. The apices of friction wheels 24 protrude through these additional apertures. Each of said friction wheels 24 and the adjacent roller for one of the cogged belts 21 and 22 are non-rotatably connected to the same shaft and are intermittently driven thereby.

Small undriven rollers 25 are provided on the edge of the sheet-supporting surface 19 of the receiving station 17 which is nearest to the viewer of FIG. 2. Rollers 25 are disposed downstream from the rollers 24 and are aligned with rollers 24 in the direction which is parallel to the arrow P. Like the apices of the driven friction wheels 24, the apices of the undriven rollers 25 protrude slightly above the sheet-supporting surface 19. The arrangement of the undriven rollers 25 is also apparent from FIG. 3.

Two lateral mounting walls 27 and 28 are disposed close to the edge of the sheet-supporting surfaces 18 and 19 of the receiving stations 16 and 17 which is remote from the viewer of FIG. 2. The mounting walls 27 and 28 rise from a housing base generally designated 26. A frame 29 is pivotally mounted in the mounting walls 27 and 28 and comprises left and right side members 30 and 31, respectively. Axles 32 and 33 extend between the side members 30 and apparatus 4, the frame 29 also comprises a crosspiece which connects the free forward ends of the side members 30 and 31 and which is provided with a handle.

Three links are pivoted on the axle 32. a first of these links is indicated at 34 in FIG. 2. The arrangement of the three links is apparent from FIG. 1. By coil springs 35, which surround the axle 32 and bear on adjustable retaining rings 36, the links are biased whereby their free ends to move toward the sheet-supporting surface 19 of the receiving station 17. Belt pulleys 37 are rotatably mounted at the free ends of the links 34. Belts 38 are trained around belt pulleys 37 and around belt pulleys 39 which are rotatably mounted on the axle 33.

It is apparent from FIG. 2 that each of the sets of belt pulleys 37 and 39 are so disposed that the lower courses of the belts 38 extend over groups of friction wheels 24 and undriven rollers 25. Because the links 34 are biased, the belt pulleys 37 and the belts 38 trained around the belt pulleys are urged against the apices of the friction wheels 24.

The entire frame 29 is biased by left and right telescopic air springs 40 and 41. Springs 40 and 41 tend to impart to the frame 29 a pivotal movement toward the planes of the sheet-supporting surfaces 18 and 19 about the pivotal axes on which the frame is connected to the lateral mounting walls 27 and 28. At one of their ends the telescopic air springs 40,41 act on corresponding ends of respective anchoring members 42,43 provided at the forward end of the outside of the side member 30 or 31. The other ends of the telescopic air springs 40,41 act on respective side walls 44,45. Side walls 44 and 45 are secured to respective sides of the housing base 26 in the manner shown.

Figure 3:
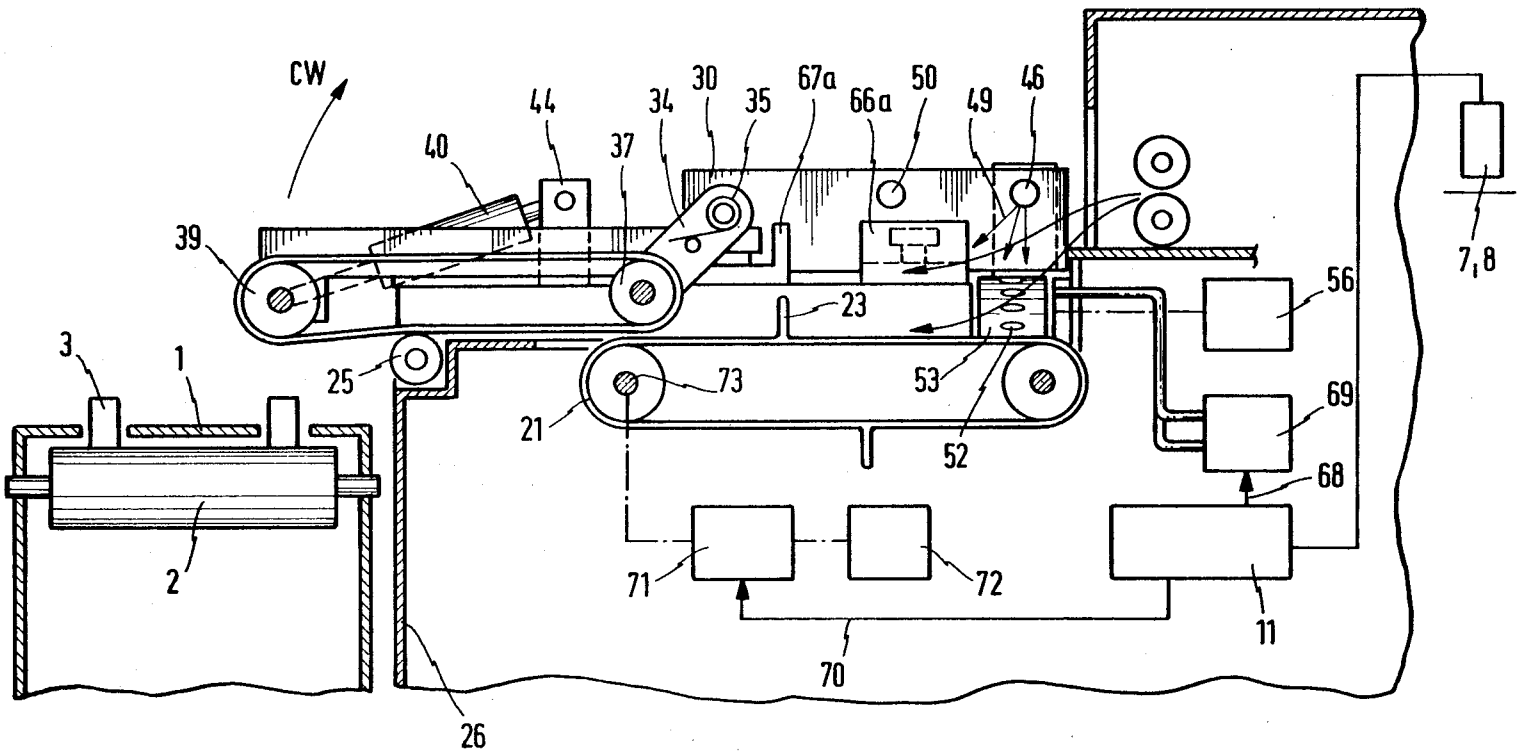
FIG. 3 is a longitudinal vertical sectional view showing a part of the system of FIG. 1.

It is apparent from FIG. 2 and particularly from FIG. 3 that in the operating position shown in the drawings the plane defined by frame 29 is positioned below the connecting points between the telescopic air springs 40 and 41 and the corresponding side wall portions 44 and 45, respectively, so that the pressure force of the telescopic air springs 40, 41 has a downwardly directed component. This downwardly directed force component acts on the frame 29 to bias the frame in the counterclockwise direction as far as the position shown in FIG. 3 is concerned. The counterclockwise biasing presses the arrangement formed by the belts 38 and the belt pulleys 37 and 39 against the friction wheels 24 and the undriven rollers 25. On the other hand, when the frame 29 is moved in direction of the arrow CW shown in FIG. 3, the plane defined by frame 29 comes in a position above the connecting points between the telescopic air springs 40 and 41 and the side wall portions 44 and 45 so that the pressure force exerted by the telescoping air springs now has an upwardly directed component. This upwardly directed force component facilitates lifting of the frame 29 (together with the construction parts fastened to the frame) in direction of the arrow around the bearings at the wall portions 27 and 28. Thereby a rather simple spring construction fulfills two functions.

A means for directing pressurized fluid, such as an air blast tube 46, is centered on the pivotal axis of the frame 29 and extends through bearing sleeves between the side members 30 and 31 of the frame 29. Air blast tube 46 is formed in its lower portion with a series of juxtaposed or linearly arranged nozzle orifices 47. The air blast tube 46 is adapted to be connected by a fitting 48 to a compressed air source (not shown) so that approximately conical or fanlike air blasts can be discharged from the nozzle orifices 47 toward the sheet-supporting surfaces 18 and 19. The compressed air blasts are indicated in FIG. 3 by the arrows 49.

In accordance with an advantageous feature of the apparatus described herein, the air blasts are not directed vetically downwardly but are somewhat inclined in the direction of travel of the form sheets on the sheet-feeding paths. The inclined direction of the air blasts ensures that stacks of form sheets or individual form sheets will not be lifted from the sheet-supporting surface by a cushion of air retained between the form sheets and the associated sheet-supporting surface.

It is apparent from FIGS. 2 and 3 that another air blast tube 50 disposed in the sheet-feeding direction behind the air blast tube 46 extends between the side members 30 and 31 of the frame 29. The air blast tube 50 is also connected by a fitting 51 to the unillustrated compressed air source. Air blast tube 50 is also formed in its lower portion with a series of nozzle orifices which are similar to the nozzle orifices 47.

An important part of the apparatus described herein is the sheet-supporting surface 18 of the receiving station 16. The special design of the sheet-supporting surface 18 will be described in detail mainly with reference to FIGS. 2 and 4.

Sheet-supporting surface 18 has a transversely extending aperture 51 therein at a portion of surface 18 which is both proximate the edge of surface 18 and remote from the viewer in FIG. 2 and proximate the half of surface 18 which is adjacent to sheet-supporting surface 19. Aperture 51 substantially accommodates in the plane of surface 18 an upper course of an endless transverses conveyor means such as belt 53. Belt conveyor 53 has a plurality of perforations thereon along central perforation line 52. Below the sheet-supporting surface 18 the belt conveyor is trained around pulleys 54 and 55. Pulleys 54 and 55 are rotatably mounted in the housing base 26 below the sheet-supporting surface 18. The pulley 55 is coupled to a drive 56 that is diagrammatically indicated in FIG. 4. The periphery of the pulley 55 laterally protrudes somewhat beyond the vertical plane that is defined by the step 20 of the housing base 26.

Belt conveyors of the above-described kind are known from U.S. Pat. No. 3,889,801. It has been found, however, that the provision of such belt conveyor having perforations which travel over a suction block as a transverse conveyor in one of the receiving stations of the apparatus affords advantages which affect the entire structure and the operation of automatic serial mailing systems.

The upper course of the belt conveyor 53 extends over a manifold means such as suction block 57. Suction block 57 includes an elongate suction aperture or chamber 58. Aperture 58 is aligned with the perforation line 52 and is adapted to be connected to a vacuum line 59 by passages formed in the suction block 57. It will be understood that the illustrative embodiment shown in FIG. 4 may be modified in that the suction block 57 is elongated to extend throughout the region between the pulleys 54 and 55. According to the modification the suction chamber 58 extends almost throughout the free length of the upper course of the belt conveyor 53 between the pulleys 54 and 55 whereby the vacuum or suction action is obtained along the largest possible length of the revolving belt conveyor 53.

The sheet-supporting surface 18 is formed with two sheet-retaining vacuum openings or apertures 60 and 61. Apertures 60 and 61 are spaced from the belt conveyor 53 opposite to the direction of transfer on said conveyor. Openings 60 and 61 are adapted to be connected to a vacuum source 63 by connecting lines 62 which extend from the sheet-supporting surface 18 on the underside thereof.

Figure 4:
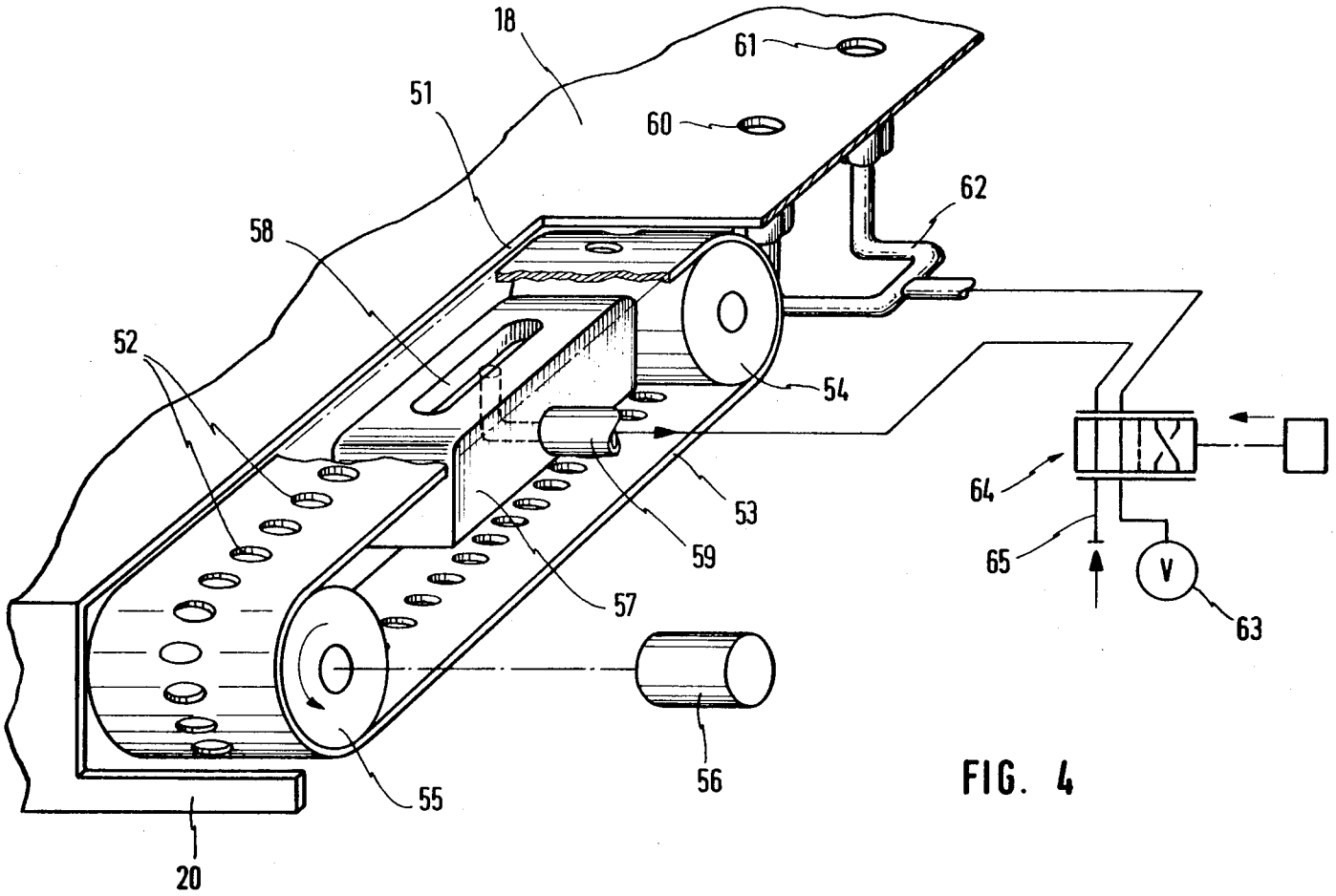
FIG. 4 is a sectional perspective view showing a transverse conveyor.

It is apparent from FIG. 4 that the lines 62 connected to the retaining vacuum openings 60 and 61 and the vacuum lines 59 connected to the suction block 57 communicate with a sliding control valve 64. In one control position the valve 64 connects the vacuum source 63 and an air supply line 65 to the sheet-retaining vacuum openings 60 and 61 and to the suction block 57, respectively. In the other control position the valve 64 interchanges the connections. The mode of operation of the arrangement shown in FIG. 3 will be described in more detail hereinafter.

It is also apparent from FIG. 2 that the sheet-supporting surface 18 is provided with two adjustable stop angles 66*a* and 67*a*, which can be fixed on the sheet-supporting surface 18 by means of suitable set screws in positions selected in view of the format of the form sheets to be handled.

OPERATION

When the discriminating and control device 11 processing the output signals of the code readers 7 and 8 detects that the code read by the code reader 8 agrees with the code read by the code reader 7, the device 11 determines that the juxtaposed sheet form areas on the sheet web having the code so read belong to the same set of form sheets. The juxtaposed sheet form areas on the sheet web can be, for example, sheet form areas which upon separation are pages of statements of accounts issued by banks. Information indicative of whether or not an agreement was determined is delayed by a shift register for a time corresponding to the time required by the form sheets to travel from the entrance station 5 to the apparatus 4 in the manner briefly explained hereinbefore. When the juxtaposed form sheets designated 66 and 67 in FIG. 2 (which have been folded in the meantime in the folding station 14) arrive in the apparatus 4, the delayed information causes the discriminating and control device 11 to deliver an output signal via line 68 to a controller 69. Controller 69 comprises the sliding control valve 64. In response to the output signal on line 68, controller 69 operates the valve 64 to disconnect the sheet-retaining vacuum openings 60 and 61 from the vacuum source 63 and to cause openings 60 and 61 to instead be supplied with air. Operation of valve 64 by controller 69 also disconnects the suction block 57 from the air supply line 65 (to which said suction block is connected in a condition of rest) and connects the suction block instead to the vacuum source 63.

Before that operation of the sliding control valve 64 as described above, the form sheet 67 had entered the receiving station 16 had been entrained and subsequently retained by the retaining vacuum openings 60 and 61 with the assistance of the air blasts from the air blast tubes 46 and 45. The continuously revolving belt conveyor 53 was unable to convey the form sheet as long as no vacuum was applied to the suction block. After the connections to the retaining vacuum openings and the suction block 57 have been interchanged, the form sheet 67 is entrained by the upper course of the belt conveyor moving over the evacuated suction chamber 58. After the interchange the form sheet is released by the sheet-retaining vacuum openings 60 and 61 (which are now supplied with air) the form sheet can quickly be transferred to the receiving station 17 and be stacked on top of the form sheet 66 previously fed to the receiving station 17.

When the sheet web 6 has been advanced by one form sheet area after the above-described processing by the discriminating and control device 11, and the device 11 then determines that the code now read by the code reader 7 does not agree with the code previously read by the same code reader, the just-described transfer of the form 67 to the receiving station 17 has completed the assembling of a set of form sheets. The control signal now delivered by the discriminating and control device 11 on the line 70 (with a time delay corresponding to he time required by the form sheets to travel from station 5 to station 4) will not actuate a solenoid clutch 71. Clutch 71 normally couples a drive motor 72 to the shaft 73. The belt pulleys for the cogged drives 21 and 22 and the wheels 24 are non-rotatably secured to shaft 73.

The control signal delivered via the line 70 has such a duration whereby the cogged belts 21 and 22 are revolved for such a time that the stacks of form sheets collected behind the flights 23 are conveyed between the wheels 24 and the belts 38 and are then delivered by the latter to the enveloping line 1. The duration of the control signal on line 70 may be controlled by photoelectric cells (which are responsive to the passing of the entraining flights 23) whereby the flight 23 will be positioned exactly in accordance with the format of the sheet forms to be handled.

The transverse conveyor 53 which has been described and shown in FIG. 4 occupies only a small area of the sheet-supporting surface 18 of the receiving station 16. Yet the transverse conveyor 53 permits a very precise transverse conveyance of the form sheets even though the transverse conveyor operates only near the edges of the form sheet that has entered the receiving station 16. The arrangement of the transverse conveyor close to the conveyor that is disposed at the inlet and adjacent to the receiving station 17 does not adversely affect the function of the transverse conveyor and permits an adjustment of the stop angles 66*a* and 67*a* within wide ranges for the handling of sheet formats within a large range.

Figure 6A:
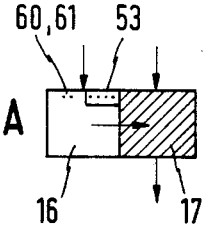

FIG. 6A is a diagrammatic sketch illustrating the mode of operation of apparatus as shown in FIGS. 1 to 3. The receiving station 16 is fed with form sheets which have been fed on the left-hand sheet-feeding path and have been delivered, e.g., by the folding station 14. The receiving station 17 is fed in alternation with form sheets from the right-hand sheet-feeding path, e.g., from the folding station 14, and with form sheets transferred from the receiving station 16 by the transverse conveyor 52. As a result, sets of form sheets are collected in the receiving station 17 which, in accordance with the embodiment of FIGS. 2 and 3, has a sheet-supporting surface 19 on a lower level. Form sheets which have been folded may be collected, if desired.

Figure 6B:
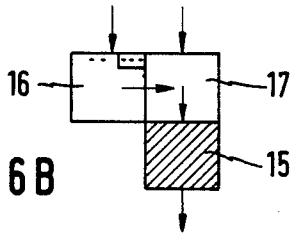

When an assembling of a set of form sheets which have been delivered in two different directions is to be avoided because such assembling of the set of form sheets may sometimes cause problems, the embodiment shown in FIG. 6B may be used. According to the FIG. 6B embodiment the receiving station 17 is succeeded by a separate collecting station 75. Collecting station 75 is disposed on a somewhat lower level than the sheet-supporting surface 19 of the receiving station 17 and (like the receiving station 17) is provided with conveying means for delivering the set of sheets to the enveloping line 1. In the embodiment shown in FIG. 6B the receiving station 17, like the receiving station 16, contains only one form sheet at a time. The form sheet is fed to the station 17 from the right-hand sheet-feeding path or by means of the transverse conveyor from the receiving station 16.

Figure 6C:
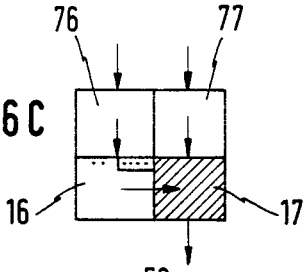

In another embodiment shown in FIG. 6C, the receiving stations 16 and 17 are preceded by respective additional receiving stations 76 and 77. Stations 76 and 77 each receive form sheets from the left-hand and right-hand sheet-feeding paths, respectively, before the form sheets are fed to the receiving stations 16 and 17, respectively. In the receiving station 17 the form sheets received by the receiving stations 16 and 77 are assembled in sets. The embodiment shown in FIG. 6C affords the advantage that the successive handling and processing stations such as those shown in FIG. 1 need not be stopped between the point in time at which the code readers 7 and 8 detect that a form sheet belongs to the set which is being assembled and the point in time at which that form sheet is received by the receiving station 17. Accordingly, the assembled sets of form sheets will be separated from each other when the code readers 7 and 8 indicate that the read code has been changed and that form sheet areas belonging to a new set of form sheets have arrived on the sheet web.

The embodiment of FIG. 6C allows an ordinary assembly of sheets in the receiving station 17 also (1) in those cases in which the fact that a form sheet belongs to a new set of sheets (and no longer to the set which has been assembled just before) can only be ascertained after the respective form sheet has already left the entrance station 5, or (2) in cases in which, after code readers 7 and 8 notice that a form sheet belongs to a new set, the entrance station cannot be stopped in time so that the form sheet which does not belong to the previously assembled set leaves the entrance station 5 in the direction toward the receiving station 17. In those cases the respective form sheet belonging to the new set can be prestored in the additional receiving stations 76 or 77 of the embodiment of FIG. 6C.

The information detected by the code readers 7 and 8 regarding the fact that a form sheet belongs to a given set thereof can be shifted through a shift register in step with the advance of the form sheets on the sheet-feeding path and will be available when the form sheets are to be forwarded from receiving stations 76 and 77 to the receiving stations 16 and 17. This detected information will then control the forwarding of form sheets and the delivery of the set collected in the receiving station 17 in such manner that the beginning of a new set of form sheets indicated by the output signals of code readers 7 and 8 has the effect that first receiving secton 17 is emptied and only thereafter form sheets are transferred again from receiving stations 76 and 77 to receiving stations 16 and 17. In this way receiving station 17 avoids receiving form sheets belonging to different sets of form sheets.

In a manner different from the embodiments shown hereinbefore, the separation between the form sheets belonging to a set thereof is not effected during the travel on the relatively long path from the entrance station 5 to the receiving station 17 but during the travel on the relatively short path from the receiving stations 76 and 77 to the receiving stations 16 and 17, so that the several handling and processing stations of the system can be operated in a more continuous and faster manner.

Figure 6D:
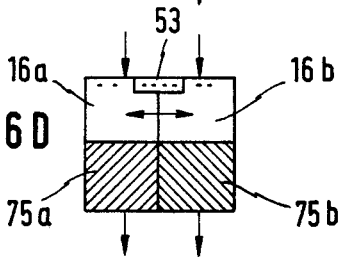

In another modified embodiment shown in FIG. 6D, two receiving stations similar to the receiving station 16 are arranged one beside the other and on substantially the same level. Such receiving stations are designated **16*a* and 16*b* in FIG. 6D. A perforated belt conveyor 53 extending over a suction block in the embodiment of FIG. 6D extends over both receiving stations 16*a* and 16*b* and can be selectively revolved in one direction or the other in that the pulleys around which the belt conveyor 53 is trained are selectively coupled by solenoid clutches to shafts driven in mutually opposite senses. Retaining vacuum openings similar to the openings 60 and 61 of the embodiment described hereinbefore are provided in the sheet-supporting surfaces of the receiving stations 16*a* and 16*b*. In the embodiment shown in FIG. 6D, a set of form sheets can be selectively assembled either in the receiving station 75*a* in alignment with the left-hand sheet-feeding path or in the receiving station 75*b*** in alignment with the right-hand sheet-feeding path. As a result, the handling rate can be increased if the sheet form areas are arranged in a certain pattern on the sheet web.

Figure 5:
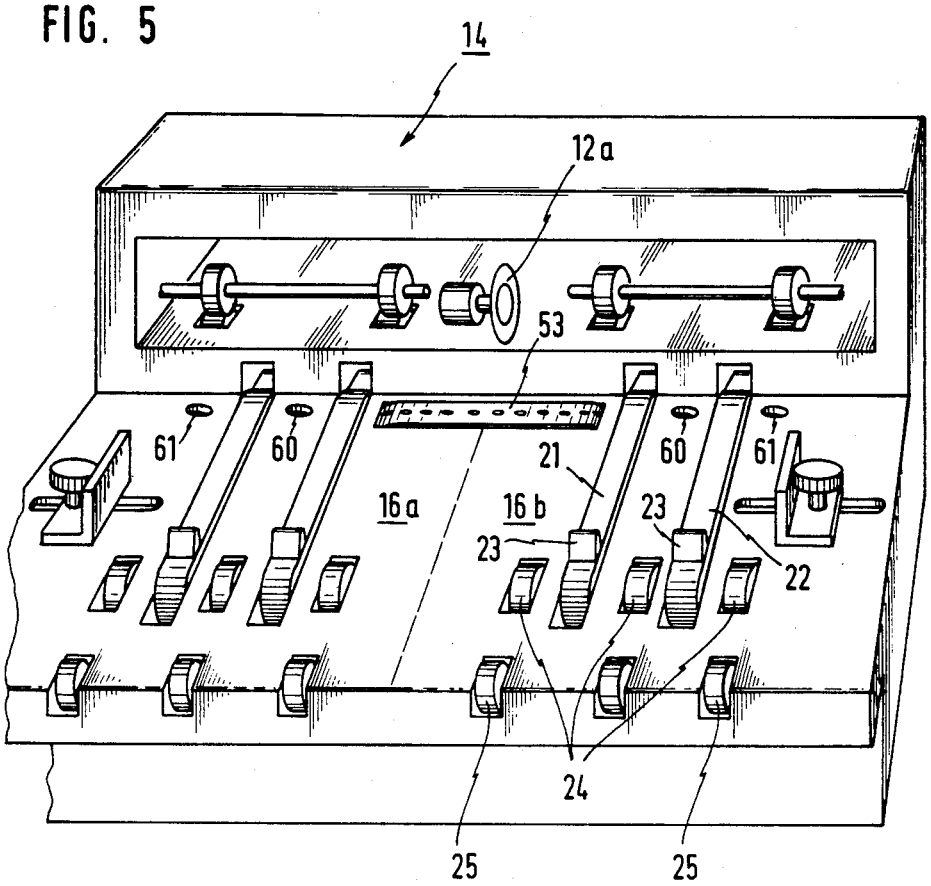
FIG. 5 is a simplified perspective view showing a modified embodiment of apparatus for handling form sheets as part of apparatus for assembling form sheets in sets thereof; and, FIGS. 6A through 6D are diagrammatic top plan views showing various embodiments of apparatus for assembling form sheets in sets thereof.

FIG. 5 is a perspective view showing the design of the receiving stations **16*a* and 16*b* without the conveying means for delivering the form sheets from the receiving stations 16*a* and 16*b*. In other respects the structure of the FIG. 5 embodiment resembles that shown in FIGS. 2 and 3, especially the structure of receiving station 17**.

The receiving stations **16*a* and 16*b* of FIG. 5 are provided with longitudinally extending apertures, which contain cogged belts 21 and 22 provided with entraining flights 23. Friction wheels 24 and undriven rollers 25 are rotatably mounted in the housing base and arranged in the manner described hereinbefore with reference to the previous embodiments. At least one of the retaining vacuum openings 60 and 61 may be disposed between the cogged belts 21 and 22, as is shown in FIG. 5**.

The receiving stations **16*a* and 16*b* are identical in all details and their parts are arranged in mirror image symmetry. The vacuum belt conveyor 53** is associated with both receiving stations.

In the folding station 14, two form sheets (which have not yet been separated by a longitudinal cut) are folded once. Immediately before leaving the folding station 14, the two form sheets are cut apart by a rotating blade **12*a*. It is apparent that the form sheets are not and need not be moved laterally apart before they enter the receiving stations 16*a* and 16*b***.

While the invention has been particularly shown and described with reference to the preferred embodiments thereof, it will be understood by those skilled in the art that various alterations in form and detail may be made therein without departing from the spirit and scope of the invention.

The embodiments of the invention in which an exclusive property or privilege is claimed are defined as follows:

1. Apparatus for collecting sheets in a set thereof, said apparatus comprising:

two juxtaposed receiving stations adapted to receive juxtaposed incoming sheets; and, means to transfer the contents of a first of said receiving stations to a second of said receiving stations in a direction which is transverse to the direction of incoming travel of the sheets to said apparatus, said transfer means comprising:

transverse conveyor means disposed in a first of said receiving stations adapted to be revolved through a course of travel, said conveyor means having perforations provided therein, an upper portion of said course of travel of said transverse conveyor means lying substantially in the plane of a sheet-supporting surface of said first receiving station;

drive means for revolving said transverse conveyor means through its course of travel; and, manifold means for communicating a source of vacuum to perforations in said transverse conveyor means as said transverse conveyor means is revolved proximate said manifold means.

2. The apparatus of claim 1, wherein said drive means is adapted to intermittently revolve said transverse conveyor means whenever a sheet belonging to a set is to be transversely transferred from said first to said second receiving station.

3. The apparatus of claim 1, wherein said drive means is adapted to continuously revolve said transverse conveyor means, wherein said sheet-supporting surface of said first receiving station has a sheet-retaining vacuum aperture formed therein, and wherein said apparatus further comprises:

means for controlling the communication of said source of vacuum to said manifold means and to said sheet-retaining vacuum aperture whereby, when a sheet belonging to a set is to be transversely transferred from said first receiving station to said second receiving station, said control means (1) connects said manifold means to said source of vacuum and (2) disconnects said sheet-retaining vacuum aperture from said source of vacuum.

4. The apparatus of claim 3, wherein said control means connects said sheet-retaining vacuum aperture to a source of fluid when a sheet belonging to a set is to be transversely transferred from said first receiving station to said second receiving station.

5. The apparatus of claim 3, wherein said sheet-retaining vacuum aperture is aligned with said transverse conveyor means and disposed on said sheet-supporting surface at a position opposite to the direction of transfer by said transverse conveyor means.

6. The apparatus of claim 1, wherein said transverse conveyor means is disposed at said first receiving station on a portion of said sheet-supporting surface thereof which is adjacent said second receiving station and proximate an entrance location of sheets incoming to said second receiving station.

7. The apparatus of claim 1, further comprising:

storage means downstream from said second receiving station for accumulating sheets to be assembled in a set, said storage means being situated to receive sheets from only one direction.

8. The apparatus of claim 1, wherein said sheet-supporting surface of said first receiving station lies in a first plane which is above a second plane in which a sheet-supporting surface of said second receiving station lies, and wherein said second receiving station is disposed on a side of said first receiving station whereby said second receiving station receives both (1) corresponding ones of juxtaposed sheets incoming to said second receiving station along parallel sheet-feeding paths, and (2) sheets delivered by said belt conveyor means from said first receiving station to said second receiving station in a direction which is orthogonal to said incoming parallel sheet-feeding paths.

9. The apparatus of claim 1, further comprising:

storage means located upstream from each of said first and said second receiving stations.

10. The apparatus of claim 1, further comprising:

means for directing pressurized fluid into said receiving stations.

11. The apparatus of claim 10, wherein said means for directing pressurized fluid comprises:

at least one air blast tube mounted on a frame of said apparatus whereby said tube extends over said receiving stations in an axial direction parallel to the direction of travel of the transverse conveyor means, said tube having a plurality of nozzle orifices therein, said tube being pivotally mounted with respect to said frame.

12. The apparatus of claim 1, further comprising:

cutter means located immediately upstream from said receiving stations for longitudinally separating incoming sheet material into said two juxtaposed incoming sheets.

13. The apparatus of claim 1, wherein said first and said second receiving stations have corresponding sheet-supporting surfaces, and wherein said sheet-supporting surfaces laterally adjoin each other substantially without any intervening horizontal gap.

14. The apparatus of claim 1, wherein said first and second receiving stations have corresponding sheet-supporting surfaces which lie substantially in the same plane, wherein said upper portion of said course of travel of said transverse conveyor means lies substantially in the plane of said sheet-supporting surfaces and extends into the sheet-supporting surfaces of both said first receiving station and said second receiving station.

15. The apparatus of claim 14, wherein said drive means is adapted to selectively revolve said transverse conveyor means selectively in a clockwise sense and in a counterclockwise sense through its course of travel whereby said transverse conveyor means delivers sheets selectively from either of said receiving stations to the other.

16. The apparatus of claim 1, further comprising:

a housing base;

frame means pivotable with respect to said housing base about a first axle, said first axle being disposed proximate an entrance end of said receiving stations, said first axle extending substantially parallel to said transverse conveyor;

second axle means carried by said frame means, said second axle means extending substantially parallel to said first axle;

conveying means for conveying sheets in a direction perpendicular to the axis of said second axle means when said frame means is pivoted to a first position, said conveying means being connected to said second axle means; and, biasing means connected to said housing base and to a forward end of said frame means, said forward end of said frame means being an end opposite said first axle, said biasing means providing a biasing force whereby said forward end of said frame experiences a downward component of said biasing force when said frame is in said first position and whereby said forward end of said frame experiences an upward component of said biasing force when said frame is pivoted to a second position.

17. A method of collecting sheets in a set thereof comprising the steps of:

introducing two juxtaposed incoming sheets into two corresponding juxtaposed receiving stations; and, transferring the contents of a first of said receiving stations to a second of said receiving stations in a direction transverse to the direction of incoming travel of the sheets to the apparatus, said transfer further comprising the steps of:

sucking a sheet in said first receiving station onto transverse conveyor means by communicating perforations in said transverse conveyor means with a source of vacuum; and, revolving said transverse conveying means through a course of travel, an upper portion of said course of travel lying in the plane of a sheet-supporting surface of said first receiving station, whereby said sheet sucked onto said revolving transverse conveyor means is transferred from said first receiving station to said second receiving station.

18. The method of claim 17, wherein said transverse conveyor means is intermittently revolved whenever a sheet belonging to a set is to be transversely transferred from said first to said second receiving station.

19. The method of claim 17, wherein said transverse conveyor means is continuously revolved, but wherein sucking of a sheet in said first receiving station onto said transverse conveying means occurs only when a sheet belonging to a set is to be transversely transferred from said first to said second receiving station.

20. The method of claim 19, further comprising the steps of:

retaining a sheet on said sheet-supporting surface of said first receiving station prior to said transverse transfer by connecting a sheet-retaining vacuum aperture in said surface to a source of vacuum; and, releasing a sheet from said sheet-supporting surface of said first receiving station whenever a sheet belonging to a set is to be transversely transferred from said first to said second receiving station by disconnecting said sheet-retaining vacuum aperture from said source of vacuum.

* * * * *